US006289673B1

(12) United States Patent
Tayama et al.

(10) Patent No.: US 6,289,673 B1
(45) Date of Patent: Sep. 18, 2001

(54) AIR-FUEL RATIO CONTROL FOR EXHAUST GAS PURIFICATION OF ENGINE

(75) Inventors: Akira Tayama; Hirofumi Tsuchida, both of Kanagawa; Kazuhiko Kanetoshi, Yokohama; Keiji Okada, Kanagawa, all of (JP)

(73) Assignee: Nissan Motor Co., LTD, Yokohama (JP)

( * ) Notice: Subject to any disclaimer, the term of this patent is extended or adjusted under 35 U.S.C. 154(b) by 0 days.

(21) Appl. No.: 09/418,255

(22) Filed: Oct. 15, 1999

(30) Foreign Application Priority Data

Oct. 16, 1998 (JP) ..... 10-295110

(51) Int. Cl.[7] ..... F01N 3/00

(52) U.S. Cl. ..... 60/285; 60/276; 60/277; 60/274

(58) Field of Search ..... 60/274, 276, 285, 60/277, 284

(56) References Cited

U.S. PATENT DOCUMENTS 5,379,591 * 1/1995 Iwata et al. ..... 60/276
5,509,267 * 4/1996 Theis ..... 60/274
5,577,382 * 11/1996 Kihara et al. ..... 60/276
5,678,402 * 10/1997 Kitagawa et al. ..... 60/276
5,713,199 * 2/1998 Takeshima et al. ..... 60/276
5,842,340 * 12/1998 Bush et al. ..... 60/274
5,848,528 * 12/1998 Liu ..... 60/274

* cited by examiner

*Primary Examiner*—Thomas Denion
*Assistant Examiner*—Binh Tran
(74) *Attorney, Agent, or Firm*—Foley & Lardner

(57) ABSTRACT

A catalyst in an exhaust passage for an engine is capable of storing oxygen. A memory stores, as an oxygen storage capacity, an oxygen storage amount at the time of change of the downstream air-fuel ratio on the downstream side of the catalyst from stoichiometric to lean. A processor calculates the current oxygen storage amount accurately in due consideration of a fast oxygen absorbing rate in the case of the downstream air-fuel ratio being stoichiometric, and a slow oxygen absorbing rate in the case of the downstream air-fuel ratio being lean, and controls the air-fuel ratio of the exhaust gas mixture flowing into the catalyst so as to bring the oxygen storage amount in a region under the oxygen storage capacity.

20 Claims, 8 Drawing Sheets

AIR-FUEL RATIO CONTROL FOR EXHAUST GAS PURIFICATION OF ENGINE

BACKGROUND OF THE INVENTION

The present invention relates technique of air-fuel ratio control for purification of exhaust gases from an engine.

For efficient and simultaneous purification of noxious emissions HC, CO and NOx, a three way catalyst calls for an atmosphere of a stoichiometric air-fuel ratio. A catalyst having a capability of oxygen storage can keep such a stoichiometric atmosphere of stoichiometric oxygen concentration by absorbing an excess of oxygen in an exhaust gas mixture flowing into the catalyst and releasing oxygen corresponding to an excess of reducing agents (HC, CO) in the exhaust gas mixture. When a lean exhaust gas mixture leaner than the stoichiometry flows into the catalyst, the catalyst absorbs an excess of oxygen instantly and maintains the stoichiometric atmosphere until the oxygen storage amount of the catalyst reaches saturation. When a rich exhaust gas mixture richer than the stoichiometry flows into the catalyst, the catalyst desorbs oxygen instantly to remedy the deficiency in oxygen and maintain the stoichiometric atmosphere until the stored oxygen is fully desorbed.

Thus, the oxygen storage type catalyst can hold its atmosphere at the stoichiometric state by compensating for any excess or deficiency of oxygen caused by temporary air-fuel ratio deviations. However, in the saturated state in which the oxygen storage amount reaches a saturation level or in the empty state in which the catalyst has no stored oxygen, the catalyst cannot efficiently purify HC, CO and NOx any more, so that the exhaust emission degrades.

Japanese Patent Kokai Publications No. H5(1993)-195842 and No. H7(1995)-259602 propose feedback control systems for controlling an oxygen storage amount of a catalyst to prevent degradation of exhaust emission.

SUMMARY OF THE INVENTION

Conventional assumption is that the oxygen storage amount of a catalyst reaches a greatest possible oxygen storage amount when a sensed downstream air fuel ratio on the downstream side of a catalyst turns lean. This is not always accurate, however.

As a result of experiments of the inventor of this application, it has been first found out that a catalyst absorbs oxygen even after a transition of the downstream air-fuel ratio to lean.

FIG. 2 shows the results (experimental results) of measurement of an upstream air-fuel ratio (F-A/F) on the upstream side of a catalyst, and a downstream air-fuel ratio (R-A/F) on the downstream side of the catalyst when the air-fuel ratio of an exhaust gas mixture is changed from a rich level of about 13 to a lean level of about 16. During an A period shown in FIG. 2, the catalyst absorbs oxygen at a fast rate. Therefore, excess oxygen is totally absorbed in the catalyst, and the downstream air-fuel ratio does not become lean (being held at the stoichiometric ratio) despite the upstream air-fuel ratio being lean. During a B period following the A period, the catalyst cannot absorb the whole of inflowing excess oxygen, and the downstream air-fuel ratio turns lean. Even in the B period during which the downstream air-fuel ratio is lean, the catalyst absorbs oxygen (or oxide such as NO) though its absorbing rate is slow. After the transition of the downstream air-fuel ratio to lean, the amount of oxygen absorbed at the slow absorbing rate (referred to as a slow reaction oxygen absorbing amount) is added to a maximum effective oxygen storage amount (a saturation amount of oxygen absorbed at a fast rate) which is an oxygen storage amount when the downstream air-fuel ratio turns lean. Thus, the oxygen storage amount increases beyond the maximum effective oxygen storage amount specifically in the case of fuel cutoff and lean clamp (the term "fuel cutoff" is hereinafter used to refer to both cases).

Disregard of the slow reaction oxygen absorbing amount in the B period as in a conventional system can cause errors when the fuel cutoff is canceled and the control is returned to an air-fuel ratio control to control the oxygen storage amount under the maximum effective oxygen storage amount.

It is therefore an object of the present invention to provide control devices and/or processes for accurately estimating and controlling an oxygen storage amount of a catalyst in consideration of oxygen absorption at a fast rate and a slow rate.

According to one aspect of the present invention, an air-fuel ratio control device for an engine, comprises a catalyst, a memory and a microprocessor.

The catalyst is disposed in an exhaust passage of the engine. The catalyst absorbs oxygen when an inflowing exhaust gas mixture flowing into the catalyst is excessive in oxygen as compared with a stoichiometric exhaust gas mixture of a stoichiometric air-fuel ratio, and releases oxygen stored in the catalyst when the inflowing exhaust gas mixture is deficient in oxygen as compared with the stoichiometric exhaust gas mixture.

The memory stores an oxygen storage capacity corresponding to an amount of oxygen stored in the catalyst when the air-fuel ratio of an outflowing exhaust gas mixture flowing out of the catalyst changes from a ratio substantially equal to the stoichiometric ratio to a lean air-fuel ratio.

The microprocessor is programmed to:

calculate a current oxygen storage amount based on an oxygen absorbing rate of the catalyst which is lower when the air-fuel ratio of the outflowing exhaust gas mixture is lean than when the air-fuel ratio of the outflowing exhaust gas mixture is substantially stoichiometric; and control the air-fuel ratio of the inflowing exhaust gas mixture flowing into the catalyst, based on the current oxygen storage amount so as to make the current oxygen storage amount smaller than the oxygen storage capacity when a predetermined air-fuel ratio control condition is satisfied.

An air-fuel ratio control process according to one aspect of the present invention comprises: storing an oxygen storage capacity; calculating a current oxygen storage amount based on an oxygen absorbing rate of the catalyst; and controlling the air-fuel ratio of the inflowing exhaust gas mixture flowing into the catalyst, based on the current oxygen storage amount so as to make the current oxygen storage amount smaller than the oxygen storage capacity.

An air-fuel ratio control device according to another aspect of the present invention comprises: a catalyst; a first linear air-fuel ratio sensor sensing the air-fuel ratio of the inflowing exhaust gas mixture flowing into the catalyst in a wide air-fuel ratio range; a second linear air-fuel ratio sensor sensing the air-fuel ratio of an outflowing exhaust gas mixture flowing out of the catalyst in a wide air-fuel ratio range; a memory storing an oxygen storage capacity; and a microprocessor programmed to calculate a current oxygen storage amount based on a ratio difference between the air-fuel ratio sensed by the first linear air-fuel ratio sensor and the air-fuel ratio sensed by the second linear air-fuel ratio sensor both when the outflowing exhaust gas mixture is stoichiometric and when the outflowing exhaust gas mixture is lean, and to control the air-fuel ratio of the inflowing exhaust gas mixture flowing into the catalyst, based on the current oxygen storage.

An air-fuel ratio control device according to the present invention may comprises: first means for monitoring a sensed upstream air-fuel ratio on an upstream side of the catalyst, and a sensed downstream air-fuel ratio on a downstream side of the catalyst; second means for determining an oxygen absorbing rate in accordance with the sensed upstream and downstream air-fuel ratios in such a manner that the oxygen absorbing rate is equal to a lower value when the air-fuel ratio of the outflowing exhaust gas mixture is in a lean region, and equal to a higher value when the air-fuel ratio of the outflowing exhaust gas mixture is in a stoichiometric region, and for calculating a current oxygen storage amount in accordance with the oxygen absorbing rate; third means for determining an effective oxygen storage capacity from a value of the oxygen storage amount calculated at a transition of the sensed downstream air fuel ratio from the stoichiometric region into the lean region; fourth means for controlling the air-fuel ratio of the exhaust gas mixture flowing into the catalyst by controlling an amount of fuel supply to the engine so as to reduce a deviation of the current oxygen storage amount from a target oxygen storage amount which is set smaller than the effective oxygen storage capacity.

An engine system according to the present invention may comprise: an engine; an oxygen absorbing type catalyst; a first fuel-ratio sensor for sensing the air-fuel ratio of an inflowing exhaust gas mixture flowing to the catalyst; a second fuel-ratio sensor for sensing the air-fuel ratio of an outflowing exhaust gas mixture flowing out of the catalyst; a gas flow sensor for sensing a flow rate of the inflowing exhaust gas mixture flowing into the catalyst; and a controller for calculating an oxygen storage amount in accordance with the air fuel ratio sensed by the first air-fuel ratio sensor and the flow rate of the inflowing exhaust gas mixture when the air-fuel ratio sensed by the second air-fuel ratio sensor is in a stoichiometric region, for setting, as an effective oxygen storage capacity, a value of the oxygen storage amount calculated when the air fuel ratio sensed by the second air-fuel ratio sensor is shifted from the stoichiometric region into a lean region, for increasing the oxygen storage amount beyond the effective oxygen storage capacity if the air-fuel ratio sensed by the second air-fuel ratio remains in the lean region, and for controlling the air-fuel ratio of the inflowing exhaust gas mixture by controlling an amount of fuel supply to the engine so as to reduce a deviation of the current oxygen storage amount from a target oxygen storage amount set lower than the effective oxygen storage capacity.

DETAILED DESCRIPTION OF THE INVENTION

Figure 1:
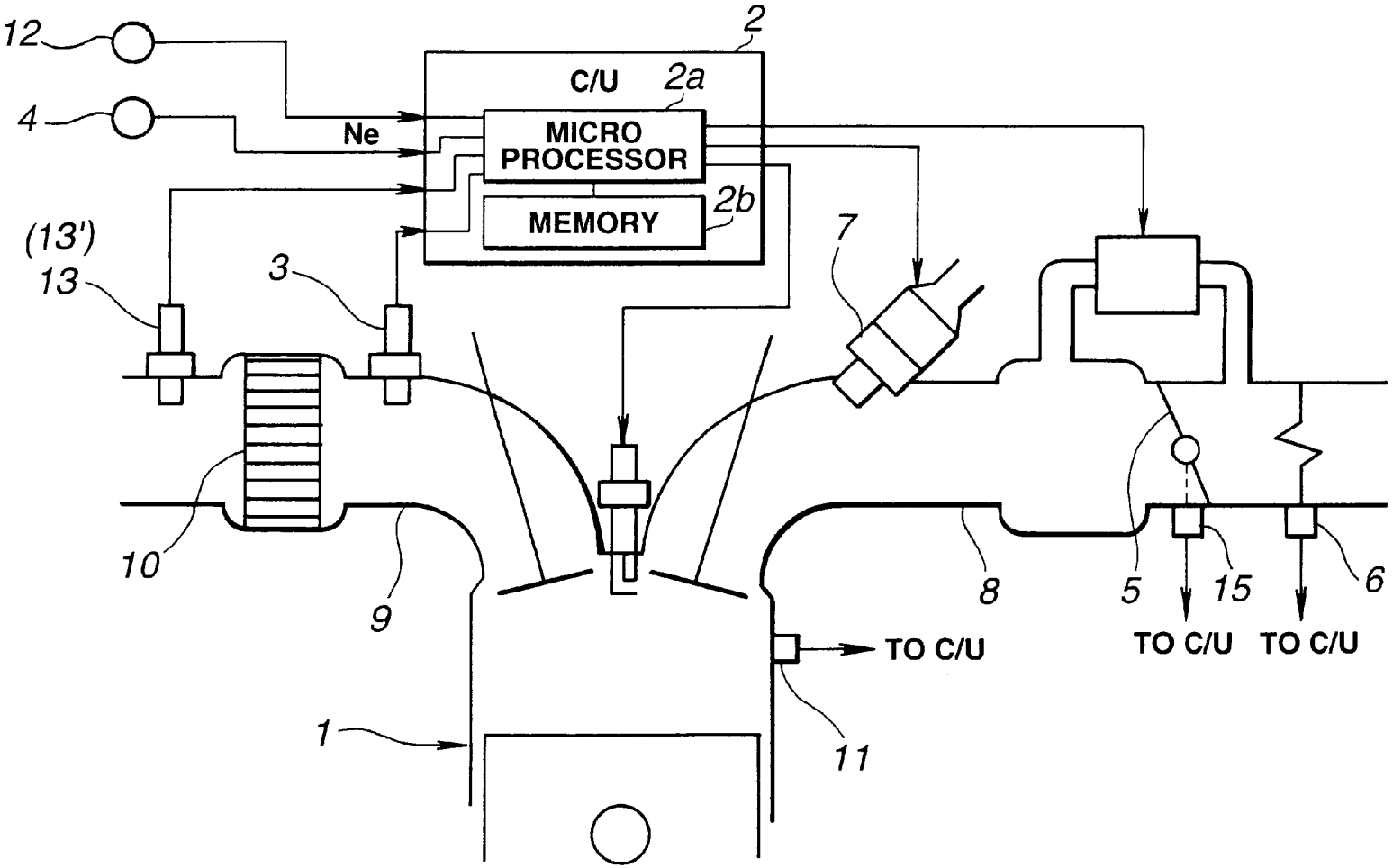
FIG. 1 is a schematic view showing a control system according to one embodiment of the present invention.
Figure 2:
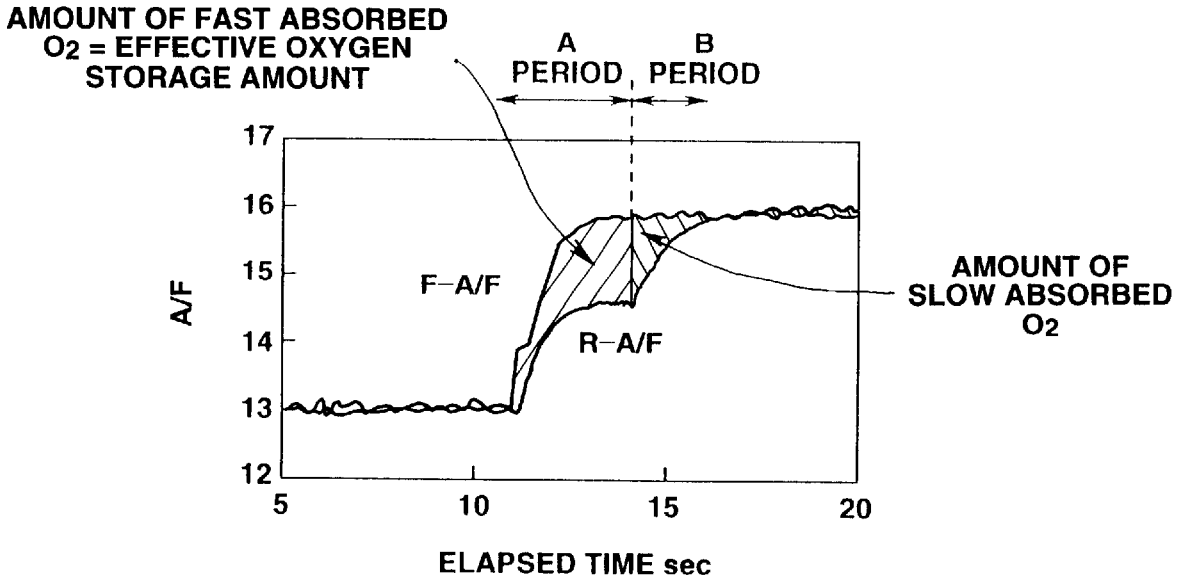
FIG. 2 is a graph showing the results of air-fuel ratio measurement on upstream and downstream side of a catalyst in transition of exhaust gases from rich to lean.

FIG. 1 shows an internal combustion engine equipped with an air-fuel ratio control device or apparatus according to one embodiment of the present invention.

Each combustion chamber of an engine 1 is connected with an intake passage 8 and an exhaust passage 9. The intake passage 8 has, therein, an intake throttle valve 5 and a fuel injector 7 on the downstream side of the throttle valve 5. The exhaust passage 9 has a three-way catalyst (or catalytic converter) 10 therein.

A control unit (C/U) 2 receives input information on engine operating conditions from various sensors. A crank angle sensor 4 senses an engine revolution speed of the engine 1. An air flow meter (or air flow sensor) 6 senses an intake air quantity of the engine 1. A throttle opening sensor (or throttle position sensor) 15 senses a throttle opening degree of the throttle valve 5. A water temperature sensor 11 senses the temperature of an engine cooling water. A linear air-fuel ratio sensor 3 senses the air-fuel ratio of the exhaust gas mixture at a position upstream of the catalyst 10. An O2 sensor 13 senses the air-fuel ratio of the exhaust gas mixture at a position downstream of the catalyst 10. The output signals of these sensors are all inputted to the control unit 2. The control unit 2 of the example shown in FIG. 1 includes a microprocessor 2*a* and a memory 2*b*. The microprocessor 2*a* is programmed to calculate a fuel injection amount in accordance with the signals from these sensors and to produce a fuel injector drive signal in accordance with the calculated fuel injection amount. The memory 2*b* stores various constants or parameters needed to calculate the fuel injection amount. The system shown in FIG. 1 is a control system, and the control unit 2 serves as a controller.

The catalyst 10 is a three-way catalyst capable of reducing NOx and oxidizing HC and CO with a highest conversion efficiency in a three-way atmosphere. The catalyst 10 has an oxygen storing capability. The catalyst 10 absorbs an excess of oxygen and stores the absorbed oxygen when the inflowing exhaust gas mixture flowing into the catalyst is excessive in oxygen. When the inflowing exhaust gas mixture is deficient in oxygen, the catalyst 10 releases the stored oxygen. The catalyst 10 traps oxygen by adsorption and absorption. In adsorption, oxygen merely adheres to the surfaces of the catalyst 10. In absorption, a component carried on the catalyst 10 takes in oxygen and forms an oxide. Hereinafter, "absorb" and "absorption" are used in a wide sense to include both the adsorption and absorption.

The linear air-fuel ratio sensor 3 can sense the air-fuel ratio in a specific wide range ranging from a rich region to a lean region across the stoichiometric ratio. The output signal of the linear air-fuel ratio sensor 3 is approximately proportional to the air-fuel ratio. The oxygen sensor 13 responds to the oxygen concentration of the exhaust gas mixture, and produces the output signal which varies sharply in the vicinity of the stoichiometric air-fuel ratio. With the oxygen sensor 13, the control unit 2 can determine whether the air-fuel ratio of the exhaust gas mixture is rich or lean or substantially stoichiometric. Although the oxygen sensor 13 is less costly than the linear air-fuel ratio sensor 3, the oxygen sensor 13 is incompetent to measure the degree of air-fuel ratio of a rich or lean mixture.

A basic concept for calculating an oxygen storage amount (OSA) of the catalyst 10 is as follows:

The oxygen storage amount of the catalyst 10 can be calculated by the following equation.

The oxygen storage amount=Σ(the amount of oxygen the catalyst absorbs or releases per unit time)

=Σ(the amount of excess/deficient oxygen flowing into the catalyst per unit time×the oxygen absorbing/releasing rate of the catalyst)

The exhaust gas mixture produced by combustion of a stoichiometric air fuel mixture of the stoichiometric ratio contains oxidizing component (O2, NO) and reducing component (HC, CO) in equivalent quantities. The complete reaction between the oxidizing component and reducing component would produce an exhaust gas mixture including no oxidizing component and no reducing component. In this specification, this state is expressed as: "The air-fuel ratio of the exhaust gas mixture is stoichiometric or theoretical."

Combustion of a lean air fuel mixture of a lean air-fuel ratio produces more oxidizing component than reducing component. Therefore, an excess oxidizing component is left behind after the complete reaction between the oxidizing and reducing components. This state is expressed herein as: "The air-fuel ratio of the exhaust gas mixture is lean.", or "The exhaust gas mixture is excessive in oxygen with respect to the stoichiometric exhaust gas mixture." The amount of the excess oxidizing component is referred to as "excess oxygen amount".

Combustion of a rich air-fuel mixture of a rich air-fuel ratio produces more reducing component than oxidizing component. Therefore, an excess reducing component remains after the complete reaction between the oxidizing and reducing components. This state is herein expressed as: "The air-fuel ratio of the exhaust gas mixture is rich.", or "The exhaust gas mixture is deficient in oxygen with respect to the stoichiometric exhaust gas mixture." The amount of oxygen corresponding to the amount of the excess reducing component is referred to as "deficient oxygen amount". In the above-mentioned equation, the deficient oxygen amount is treated as a negative quantity.

The oxygen absorbing rate of the catalyst 10 represents a percentage of the inflowing excess oxygen which the catalyst can absorb. The oxygen releasing rate represents a percentage of the inflowing deficient oxygen which the catalyst can release.

The amount of excess/deficient oxygen flowing into the catalyst 10 per unit time can be expressed as a product of the exhaust gas flow rate (=the amount of inflowing exhaust gas mixture flowing into the catalyst 10 per unit time) and the concentration of the excess/deficient oxygen in the inflowing exhaust gas mixture. Therefore, the above equation is rewritten as:

The oxygen storage amount=Σ(the exhaust gas flow rate×the excess/deficient oxygen concentration on the upstream side of the catalyst×the oxygen absorbing/releasing rate of the catalyst) (1)

Moreover, the oxygen absorbing or releasing rate is equal to (the excess/deficient oxygen concentration on the upstream side of the catalyst−the excess/deficient oxygen concentration on the downstream side of the catalyst)/the excess/deficient oxygen concentration on the upstream side of the catalyst. Therefore, the oxygen storage amount of the catalyst is given by:

The oxygen storage amount=Σ{the exhaust gas flow rate×(the excess/deficient oxygen concentration on the upstream side of the catalyst−the excess/deficient oxygen concentration on the downstream side of the catalyst) (2)

FIGS. 3~6 show the fuel injection quantity calculating control process programmed in the microprocessor 2*a*.

Figure 3:
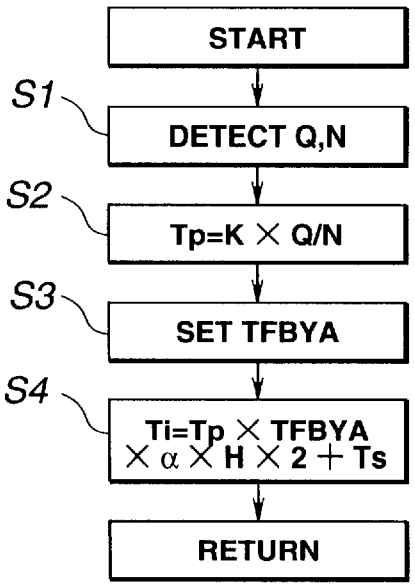
FIG. 3 is a flowchart showing a fuel injection pulse calculating routine used in the control system of FIG. 1.

FIG. 3 shows a routine performed at regular time intervals (of 10 ms, in this example), for calculation of a fuel injection pulse width Ti (for one engine revolution, corresponding to a fuel quantity for each cylinder) in sequential fuel injection. The calculated pulse width Ti is stored in the memory 2*b* for use in a fuel injection routine (not shown) (which, in this example, is performed in synchronism with the engine revolution). In the fuel injection routine, the control unit 2 delivers, to the injector 7, an injector drive signal to hold the injector 7 open for a duration of Ti from a predetermined fuel injection start timing, once in two revolutions for each cylinder.

At a step S1, the control unit 2 determines the intake air quantity Q and the engine speed N from the intake air quantity signal from the air flow meter 6 and the engine revolution speed signal from the crank angle sensor 4.

At a step S2, the control unit 2 calculates a base fuel injection pulse width Tp from the intake air quantity Q, the engine speed N and a constant K (Tp=K×Q/N). The base fuel injection pulse width Tp corresponds to a fuel injection quantity to produce a stoichiometric air fuel mixture.

At a step S3, the control unit 2 determines a target equivalent ratio TFBYA in accordance with various engine operating conditions. The target equivalent ratio TFBYA is set greater than one to set the target air-fuel ratio on a rich side when a warming up condition (that the engine cooling water temperature sensed by the temperature sensor 11 is equal to or lower than a predetermined warm-up end temperature) exists or when a high load enrichment condition exists (that the engine operating point determined by the engine operating conditions Tp and N is in a high load, high engine speed region). The target equivalent ratio TFBYA is set smaller than one when a predetermined lean air-fuel ratio operating condition exists in the case of an engine having a lean combustion mode. The target equivalent ratio TFBYA is set equal to zero when a fuel cutoff condition exists (that the engine speed N is equal to or higher than a predetermined speed and the throttle valve 5 is fully closed). When a later-mentioned air-fuel ratio control condition exists, the target equivalent ratio TFBYA is fixed at one.

At a step S4, the control unit 2 calculates a fuel injection pulse width Ti according to the following equation.

$$Ti=Tp\times TFBYA\times\alpha\times H\times 2+Ts$$

In this equation, α is a feedback air-fuel ratio correction coefficient based on the signal of the linear air-fuel ratio sensor 3. The feedback air-fuel ratio correction coefficient $\alpha$ is calculated in a routine shown in FIG. 4. A coefficient H is a feedback air-fuel ratio correction coefficient based on the calculated oxygen storage amount of the catalyst 10. This coefficient H is calculated in a routine shown in FIGS. 5 and 6. A term Ts is a pulse width correction quantity determined by a battery voltage of a battery for driving the injector 7.

Figure 4:
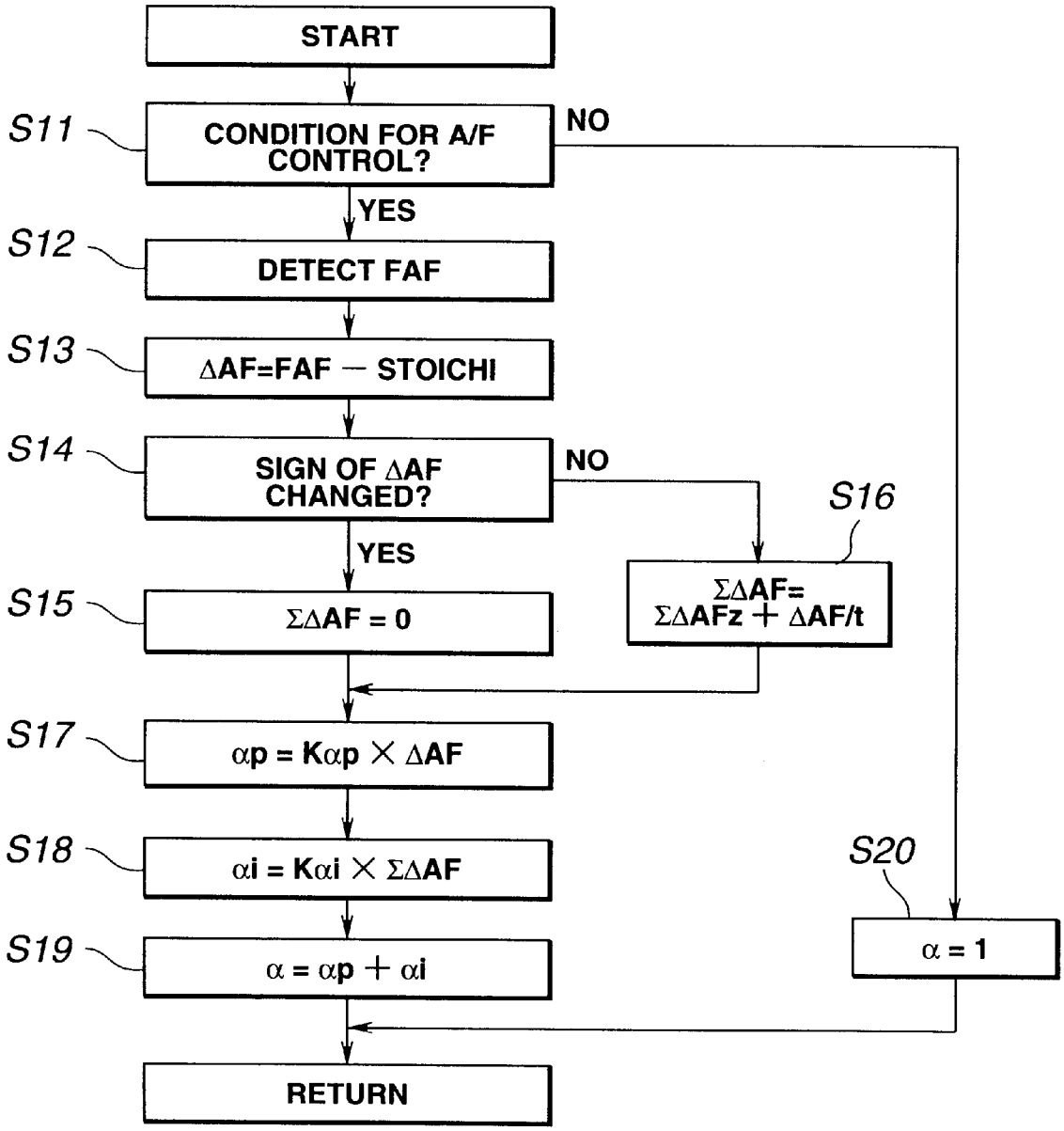
FIG. 4 is a flowchart showing a routine for calculating a feedback correction coefficient a based on a sensed upstream side air-fuel ratio, used in the control system of FIG. 1.

FIG. 4 shows the routine for calculating the feedback air-fuel ratio correction coefficient $\alpha$ based on the detection of the linear air-fuel ratio sensor 3, performed at regular time intervals (of 10 ms in this example).

At a step S11, the control unit 2 determines whether a predetermined air-fuel ratio control condition exists. In this example, the control unit 2 affirms the existence of the air-fuel ratio control condition when the linear air-fuel ratio sensor 3 has been activated, and at the same time none of the warming up condition, the high load enrichment condition, the lean air-fuel ratio operating condition, and the fuel cutoff condition exists. When the existence of the air-fuel ratio control condition is affirmed, the control system performs the air-fuel ratio control for controlling the average air-fuel ratio of the exhaust gas mixture flowing into the catalyst 10 toward the stoichiometric ratio by controlling the air-fuel ratio of combustion in the engine.

At a step S12, the control unit 2 receives the sensor signal representing a sensed upstream air-fuel ratio FAF, from the linear air-fuel ratio sensor 3 on the upstream side of the catalyst 10.

At a step S13, the control unit 2 calculates an air-fuel ratio deviation $\Delta AF$ of the sensed upstream air-fuel ratio FAF from the stoichiometric ratio STOICHI (14.7 in the case of ordinary gasoline fuel) as the target ratio.

At a step S14, the control unit 2 determines whether the sign (positive or negative) of the air-fuel ratio deviation $\Delta AF$ is inverted. When the upstream air-fuel ratio FAF on the upstream side of the catalyst 10 is on the lean side of the stoichiometric ratio, the sensed upstream air-fuel ratio FAF is greater than 14.7 and hence the air-fuel ratio deviation $\Delta AF$ is positive. When the upstream air-fuel ratio FAF is on the rich side, the air-fuel ratio deviation $\Delta AF$ is inverted to negative.

At steps S15 and S16, the control unit 2 calculates an integral $\Sigma\Delta AF$ of the air-fuel ratio deviation $\Delta AF$ for a later-mentioned integral control. When the air-fuel ratio deviation $\Delta AF$ has been just changed from positive to negative or vice versa, the integral $\Sigma\Delta AF$ is cleared to zero at the step S15. Otherwise, the $\Sigma\Delta AF$ is increased by $\Delta AF/t$ at the step S16. That is, $\Sigma\Delta AF=\Sigma\Delta AFz+\Delta AF/t$. In this equation, t is an execution cycle time of this routine (10 ms in this example), and $\Sigma\Delta AFz$ is a previous value of $\Sigma\Delta AF$ calculated in the previous execution of this routine (10 ms before). Hereinafter, the suffix z is used in the same meaning.

Then, the control unit 2 calculates a proportional term $\alpha\rho$ of the feedback correction coefficient from the air-fuel ratio deviation $\Delta AF$ and a proportional gain $K\alpha\rho$ ($\alpha\rho=K\alpha\rho\times\Delta AF$) at a step S17, and further calculates an integral term $\alpha i$ of the feedback correction coefficient from the integral $\Sigma\Delta AF$ of air-fuel ratio deviation $\Delta AF$ and an integral gain $K\alpha i$ ($\alpha i=K\alpha i\times\Sigma\Delta AF$) at a step S18. At a next step S19, the control unit 2 calculates the feedback air-fuel ratio correcting coefficient $\alpha$ by adding the proportional term $\alpha\rho$ and the integral term $\alpha i$ ($\alpha=\alpha\rho+\alpha i$).

In the case of nonexistence of the air-fuel ratio control condition, the control unit 2 proceeds from the step S11 to a step S20 and fixes the feedback air-fuel ratio correcting coefficient a at one ($\alpha=1$).

Figure 5:
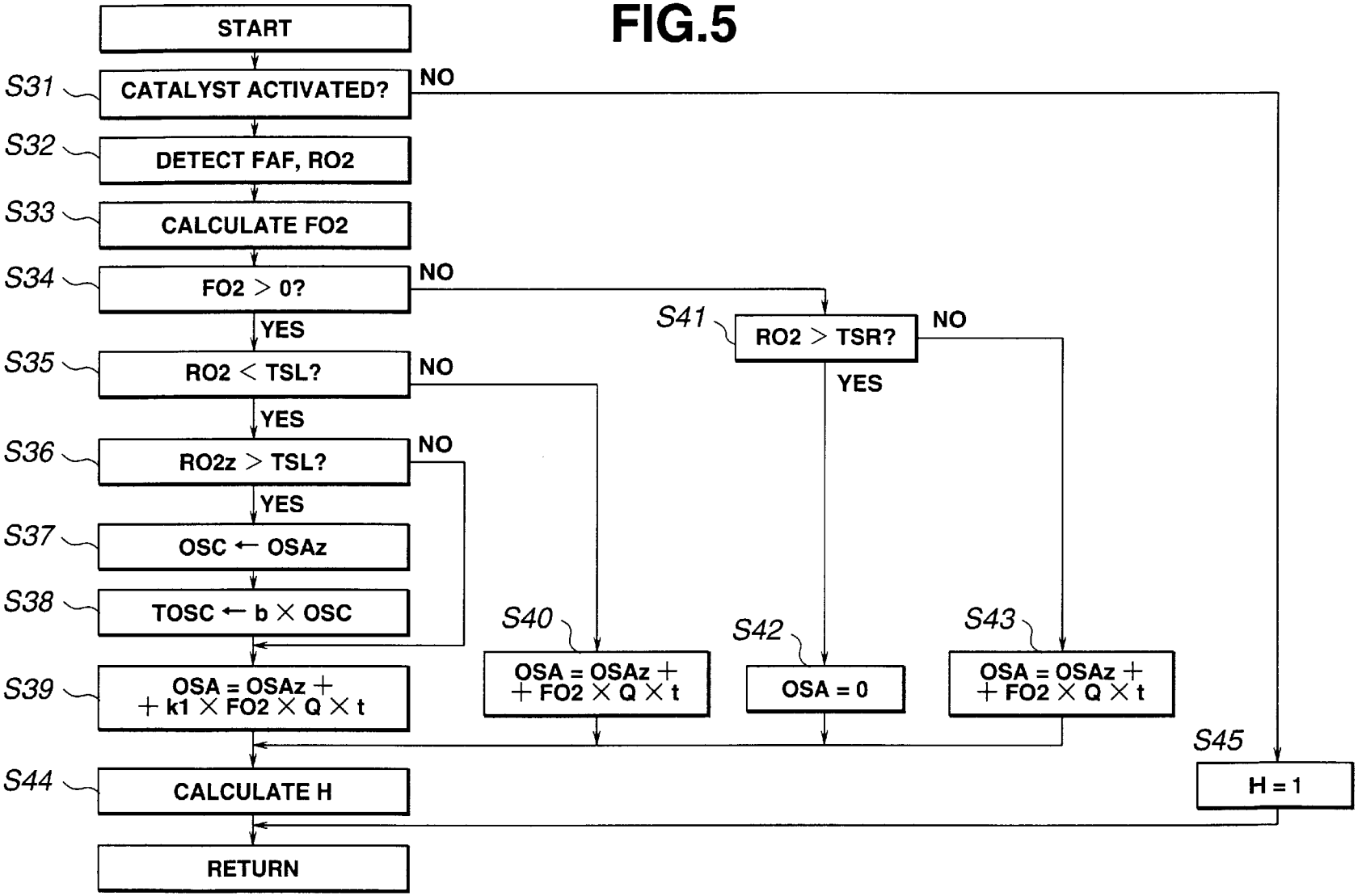
FIG. 5 is a flowchart showing a routine for the control system of FIG. 1 to calculate an oxygen storage amount (OSA).

FIG. 5 shows the routine for calculating the oxygen storage amount OSA of the catalyst 10 according to the equation (1), performed at regular time intervals (of 10 ms in this example).

At a step S31, the control unit 2 determines whether the catalyst 10 is activated or not. In this example, the control unit 2 checks the engine cooling water temperature sensed by the temperature sensor 11 to determine whether the catalyst 10 is activated.

At a step S32, the control unit 2 reads the detection signal FAF of the linear air-fuel ratio sensor 3 on the upstream side of the catalyst 10, and the detection signal RO2 of the O2 sensor 13 on the downstream side of the catalyst 10. When the answer of the step S31 is YES, it is safe to judge that the linear air-fuel ratio sensor 3 and the oxygen sensor 13 are already activated because these sensors 3 and 13 can be activated earlier than the catalyst 10.

Figure 7:
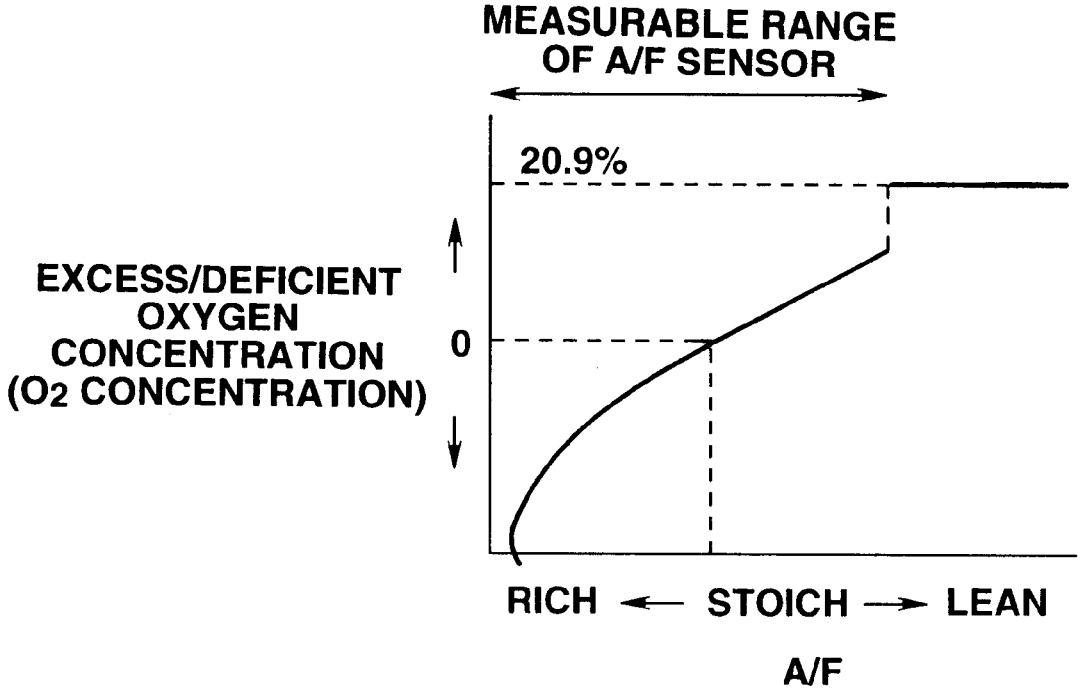
FIG. 7 is a graph showing a relation of an excess/deficient oxygen concentration with respect to an air-fuel ratio sensed by a linear air-fuel ratio sensor, used in the control system of FIG. 1.

At a step S33, the control unit 2 converts the sensed upstream air-fuel ratio FAF to the excess/deficient oxygen concentration FO2 according to a characteristic shown in FIG. 7. The excess/deficient oxygen concentration FO2 is equal to zero at the stoichiometric air-fuel ratio, positive when the air-fuel ratio is lean (FAF>14.7) and negative when the air-fuel ratio is rich (FAF<14.7).

As shown in FIG. 7, the wide range air-fuel ratio sensor has its measurable sensing range in which the sensor can measure the air-fuel ratio properly. Therefore, the air-fuel ratio sensor is unable to properly sense the air-fuel ratio (and hence the excess/deficient oxygen concentration) during fuel cutoff operation rendering the air-fuel ratio too lean beyond the measurable range. However, the air-fuel ratio required for combustion is within a predetermined limited range, and it is possible to employ the wide range air-fuel ratio sensor covering the predetermined range of the required air-fuel ratio for combustion. In this case, the air fuel ratio cannot become excessively lean beyond the measurable range normally, except by fuel cutoff. In this example, therefore, the excess/deficient oxygen concentration FO2 is set equal to a predetermined value (20.9%) of the air of the atmosphere when the output signal of the wide range air-fuel ratio sensor covering the range of the required air-fuel ratio indicates an excessively lean air-fuel ratio outside the measurable sensing range.

Figure 8:
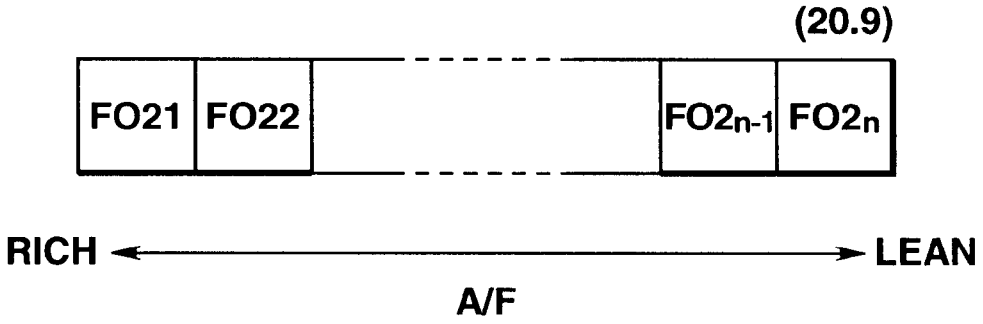
FIG. 8 is a view showing a table the control system of FIG. 1 uses to determine the excess/deficient oxygen concentration from the sensed air-fuel ratio.

The characteristic of FIG. 7 is stored in the form of a table as shown in FIG. 8.

Reverting to the flowchart of FIG. 5, a step S34 checks whether the excess/deficient oxygen concentration FO2 calculated at the step S33 is positive or not. When FO2 is positive, the catalyst absorbs an excess oxygen in the exhaust gas mixture.

At a step S35, the control unit 2 determines whether the air-fuel ratio of the exhaust gas mixture on the downstream side of the catalyst 10 is lean or not. When the output signal RO2 inputted at the step S32 is smaller than a lean side threshold TSL, the control unit 2 judges that the air-fuel ratio on the downstream side of the catalyst 10 is lean, and proceeds to a step S36. When RO2≧TSL, the control unit 2 proceeds to a step S40. The execution of a later-mentioned feedback oxygen storage amount control normally prevents the exhaust gas mixture on the downstream side of the catalyst 10 from becoming lean. Therefore, the affirmative answer of the step S35 is obtained only in a limited number of cases; the case in which the air-fuel ratio is made lean to a significant extent by relatively large disturbance, the case in which the oxygen storage capacity (maximum effective oxygen storage amount) OSC is decreased by degradation of the catalyst 10, and the case in which the fuel cutoff is under way.

At the step S36, the control unit 2 determines whether the previous value RO2z of the output signal of the oxygen sensor 13 inputted in the previous execution cycle of this routine (10 ms before) is smaller than the lean side threshold TSL. If ROz>TSL, the control unit 2 proceeds to a step S37. If Roz≦TSL, the control unit 2 proceeds directly to a step S39.

Just after the air-fuel ratio on the downstream side of the catalyst 10 turns from stoichiometry to lean, the answer of the step S36 becomes YES, and the control unit 2 proceeds to steps S37 and S38 for learning and updating of the effective oxygen storage capacity (maximum effective oxygen storage amount) OSC and a true oxygen storage capacity (total oxygen storage amount) TOSC.

The control unit 2 writes the previous value OSAz of the oxygen storage amount calculated in the previous execution cycle, as a new effective oxygen storage capacity OSC, into the memory 2*b* at the step S37. Then, at the step S38, the control unit 2 writes a product obtained by multiplying the newly stored oxygen storage capacity OSC by a constant b (b>1), as a new true oxygen storage capacity TOSC, into the memory 2*b*.

The effective oxygen storage capacity OSC represents an upper limit of a range of the oxygen storage amount capable of holding the catalyst 10 in the three-way atmosphere. When the oxygen storage amount of the catalyst 10 is small, the catalyst 10 can absorb the whole quantity of excess oxygen instantly even if the inflowing exhaust gas mixture is more or less lean, and thereby maintain the three way atmosphere. When the oxygen storage amount OSA in the catalyst 10 reaches the oxygen storage capacity OSC, the catalyst 10 becomes unable to instantly absorb the whole quantity of the excess oxygen in the inflowing exhaust gas mixture, and accordingly the atmosphere becomes an oxidizing atmosphere excessive in oxygen. As a result, the outflowing exhaust gas mixture from the catalyst 10 become excessive in oxygen, and the air-fuel ratio on the downstream side of the catalyst 10 becomes lean. Thus, the catalyst can be held in the three way atmosphere until the oxygen storage amount OSA reaches the oxygen storage capacity OSC.

Since the oxygen storage capacity OSC becomes lower with degradation of the catalyst, the control system of this example according to the embodiment of the present invention is arranged to update the oxygen storage capacity by sensing the air-fuel ratio on the downstream side of the catalyst 10. It is possible to determine an initial oxygen storage capacity of a catalyst not yet degraded, from the amount of noble metal carried by the catalyst, and the amount of promoter (such as cerium) for strengthening the oxygen storage function. Alternatively, the initial oxygen storage capacity can be determined by experiment with catalysts of the same type. The thus-determined initial oxygen storage capacity can be stored as an initial value of OSC in the memory 2*b*. In the case of an engine receiving little influence from degradation of a catalyst, it is optional to store the thus-determined initial oxygen storage capacity as a fixed value, and to omit the learning and updating of OSC.

The true oxygen storage capacity TOSC is a true greatest possible oxygen storage amount the catalyst 10 can store. Even after the oxygen storage amount OSA exceeds the effective oxygen storage capacity OSC, the catalyst 10 can further absorb oxygen by slow reaction. This slow oxygen absorption soon reaches a condition of saturation, and thereafter the catalyst becomes completely unable to absorb oxygen any more. The oxygen storage amount at this state is defined as the true oxygen storage capacity TOSC. In other words, the true oxygen storage capacity TOSC is a value of the oxygen storage amount obtained when the oxygen concentration on the upstream side of the catalyst and the oxygen concentration on the downstream side of the catalyst become equal to each other as a result of continuation of the supply of an exhaust gas mixture excess in oxygen.

By experiments on variation in the ratio between the true oxygen storage capacity TOSC (total oxygen storage amount) and the effective oxygen storage capacity OSC (maximum effective oxygen storage amount) with degradation of the catalyst, it was confirmed that the ratio of TOSC to OSC remained unchanged irrespective of degradation of the catalyst. That is, when the effective oxygen storage capacity OSC decreases, the true oxygen storage capacity TOSC decreases in proportion to OSC. Therefore, it is possible to estimate the true oxygen storage capacity TOSC by the following equation using the ratio b between TOSC and OSC.

$$TOSC=b\times OSC.$$

The ratio b is a constant determined by the kind of the catalyst 10. The values of OSC and TOSC are retained as backup to protect data from being lost when the engine is turned off.

At a step S39 of FIG. 5, the control unit 2 calculates the current oxygen storage amount OSA of the catalyst 10. The step S39 is reached when the upstream exhaust gas mixture upstream of the catalyst 10 contains too much oxygen (the answer of the step S34 is YES), and the downstream exhaust gas mixture downstream of the catalyst 10 is lean (the answer of the step S35 is YES). In this case, the catalyst 10 absorbs oxygen slowly. The oxygen storage amount OSA is calculated by:

$$OSA=OSAz+k1\times FO2\times Q\times t \quad (3)$$

In this equation, OSAz is the previous value of OSA calculated in the previous operation cycle, k1 is a constant or parameter representing the oxygen absorbing rate of the catalyst 10, Q is the exhaust gas flow rate (which is replaced by the intake flow rate sensed by the intake air flow meter 6, in this example), and t is the operation cycle time (10 ms in this example). The quantity FO2×Q×t corresponds to the amount of excess oxygen flowing into the catalyst per operation cycle time (per predetermined period). The current oxygen storage amount OSA is determined by adding the product resulting from multiplication of this excess oxygen amount by the oxygen absorbing rate constant (or parameter) k1, to the previous value OSAz.

Thus, the control system according to this embodiment calculates the current oxygen storage amount OSA beyond the effective oxygen storage capacity OSC when the air-fuel ratio on the downstream side of the catalyst 10 is lean.

The oxygen absorbing (or adsorbing) rate constant (or parameter) k1 can be determined in the following manner.

The slow oxygen absorbing reaction can be simplified as the following formula.

$$R+O2\rightarrow RO2$$

In this formula, R is a substance (such as cerium Ce) capable of absorbing oxygen. The absorbing rate constant k1 is given by:

$$k1=[R]\times[O2]/[RO2]$$

In this equation, [R] is the concentration of R, [O2] is the concentration of oxygen, and [RO2] is the concentration of RO2. Therefore, the oxygen absorbing reaction is proportional to the oxygen concentration ([O2]) and hence to the excess oxygen concentration FO2, proportional to the amount of the oxygen absorbing substance ([R]) and hence to the difference between the true oxygen storage capacity TOSC and the current oxygen storage amount OSA, and inversely proportional to the amount of the product of the absorbing reaction ([RO2]) and hence the current oxygen storage amount OSA. Thus, by using a proportionality coefficient d, the absorbing rate constant (or parameter) k1 is given by:

$$k1=d\times FO2\times(TOSC-OSA)/OSA$$

The absorbing rate constant k1 is smaller than one.

A step S40 of FIG. 5 is reached when the upstream exhaust gas stream is excess in oxygen (S34 is YES), and the downstream exhaust gas mixture is not lean (S35 is NO). When the upstream exhaust gas mixture has an excess of oxygen, the downstream exhaust gas mixture can hardly become rich. Consequently, the course through the step S40 is taken in the case in which the upstream exhaust gas mixture is excess in oxygen and the downstream exhaust gas mixture is substantially stoichiometric. In this case, the catalyst 10 is in the state capable of instantly absorbing the entirety of excess oxygen. Therefore, the current oxygen storage amount OSA is given by:

$$OSA=OSAz+FO2\times Q\times t \quad (4)$$

The rate constant (or parameter) representing the oxygen absorbing rate of the catalyst 10 is set to one, so that this rate constant does not appear in the equation (4). However, it is optional to use the following equation.

$$OSA=OSAz+k2\times FO2\times Q\times t \quad (4')$$

In this case, the rate constant k2 is very close to one.

When the FO2≦0, the control unit 2 proceeds from the step S34 to a step S41, and determines at the step S41 whether the air-fuel ratio of the downstream exhaust gas mixture is rich or not, by comparing the detection signal RO2 inputted at the step S32 with a predetermined rich side threshold TSR for delimiting the rich air-fuel region. When RO2>TSR, the control unit 2 judges that the downstream exhaust gas mixture on the downstream side of the catalyst 10 is rich. When the feedback oxygen storage amount control is in progress, the downstream exhaust gas mixture normally does not become rich. In general, the answer of the step S41 becomes affirmative only in the cases of a disturbance excessively enriching the air-fuel ratio, warm-up operation and high load enrichment.

When the upstream exhaust gas mixture is deficient in oxygen (S34 is NO), and the downstream exhaust gas mixture is rich (S41 is YES), the control unit 2 proceeds from the step S41 to a step S42, and resets the oxygen storage amount OSA to zero at the step S42 (OSA=0). When the answer of the step S41 becomes affirmative, it can be assumed that the catalyst 10 is in the state in which the storage oxygen is released completely and the catalyst 10 cannot make up the deficit of oxygen by releasing oxygen. This operation resetting the oxygen storage amount to zero is advantageous in preventing accumulation of errors in calculation of OSA and correcting the value of OSA at times.

When the upstream exhaust gas mixture is deficient in oxygen (S34 is NO) and the downstream exhaust gas mixture is not rich (S41 is NO), the control unit 2 proceeds to a step S43 and calculates the oxygen storage amount OSA in the oxygen releasing state. In this state, the catalyst 10 releases oxygen and remedies the deficiency of oxygen. It can be assumed that oxygen is released in an instant, and accordingly the oxygen storage amount OSA is calculated by:

$$OSA=OSAz+FO2\times Q\times t \quad (5)$$

In the equation (5), FO2 is negative (or equal to zero) though the equation (5) is seemingly the same as the equation (4). When the oxygen releasing rate is to be taken into account, an oxygen releasing rate constant k3 is included in the equation (5), as a multiplier like k2 in the equation (4'). The releasing rate constant k3 is a value very close to one.

At a step S44 following one of the steps S39, S40, S42 and S43, the control unit 2 calculates a feedback air fuel ratio correction coefficient H based on the calculated oxygen storage amount OSA.

When the catalyst 10 is not yet activated, the control unit 2 proceeds from the step S31 to a step S45, and fixes the feedback correction coefficient H at one (H=1) since the catalyst 10 is still unable to store oxygen.

Figure 6:
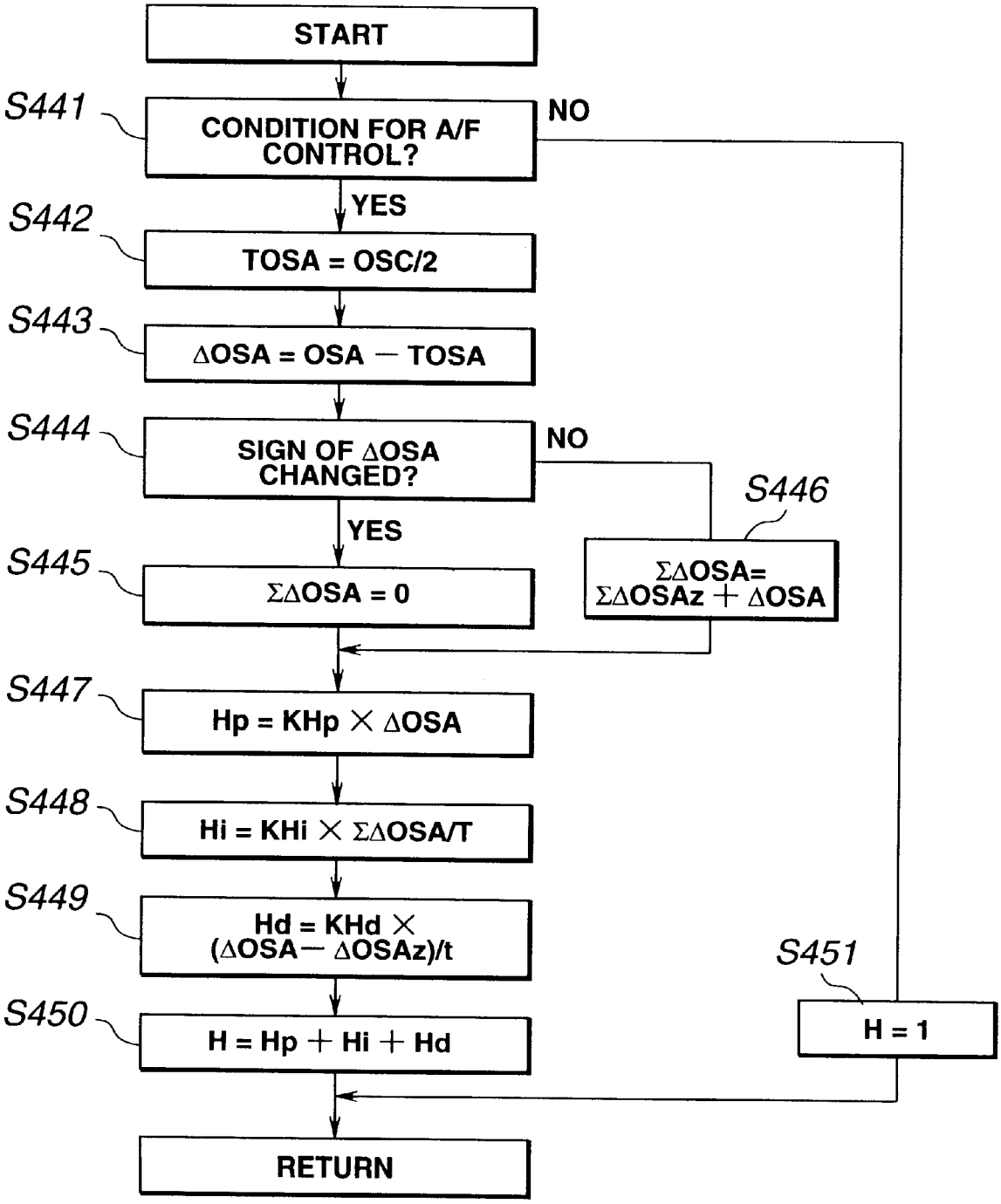
FIG. 6 is a flowchart showing a (sub)routine for calculating a feedback correction coefficient H based on the oxygen storage amount calculated in the routine of FIG. 5.

FIG. 6 shows a subroutine performed at the step S44 of FIG. 5, for determining the feedback air-fuel ratio correction coefficient H based on OSA.

At a step S441, the control unit 2 examines whether the predetermined air-fuel ratio condition is present (in the same manner as in the step S11).

At a step S442, the control unit 2 sets a target oxygen storage amount TOSA equal to one half of the effective oxygen storage capacity OSC (TOSA=TOC/2).

At a step S443, the control unit 2 calculates a deviation ΔOSA of the current oxygen storage amount OSA from the target oxygen storage amount TOSA (ΔOSA=OSA−TOSA).

At a step S444, the control unit 2 check whether the oxygen storage amount deviation ΔOSA has been changed from positive to negative or vice versa. The deviation ΔOSA is positive when the current oxygen storage amount OSA is greater than the target oxygen storage amount TOSA. The deviation ΔOSA is negative when the current oxygen storage amount OSA is smaller than the target oxygen storage amount TOSA.

Steps S445 and S446 are for calculating an integral ΣΔOSA of the oxygen storage amount deviation ΔOSA for integral control action. The integral ΣΔOSA is reset to zero at the step S445 when the sign of the deviation ΔOSA is changed. The integral ΣΔOSA is increased from a previous value ΣΔOSAz by ΔOSA at the step S446 when the sign of the deviation ΔOSA remains unchanged. That is, ΣΔOSA=ΣΔOSAz+ΔOSA.

At a step S447, the control unit 2 calculates a proportional term Hp of the feedback correction coefficient H from the oxygen storage amount deviation ΔOSA and a proportional gain KHp (Hp=KHp×ΔOSA).

At a step S448, the control unit 2 calculates an integral term Hi of the feedback correction coefficient H from the integral of the oxygen storage amount deviation ΔOSA and an integral gain KHi (Hi=KHi×ΣΔOSA/T, where T is an integral interval which is an elapsed time from an inversion of the deviation ΔOSA from positive to negative or vice versa).

At a step S449, the control unit 2 calculates a derivative term Hd of the feedback correction coefficient H from a change (ΔOSA−ΔOSAz) of the oxygen storage amount deviation ΔOSA and a derivative gain KHd. That is, Hd=KHd×(ΔOSA−ΔOSAz)/t, where t is the execution cycle time of this subroutine (10 ms in this example).

At a step S450, the control unit 2 determines the feedback correction coefficient H by adding the proportional term Hp, the integral term Hi and the derivative term Hd (H=Hp+Hi+Hd).

When the air-fuel ratio control condition is not present, the control unit 2 proceeds from the step S441 to a step S451, and fixes the feedback correction coefficient H at one (H=1). This control system performs the calculation of the oxygen storage amount OSA in the routine of FIG. 5 always as long as the catalyst 10 is activated, and performs the feedback air-fuel ratio control based on the calculated oxygen storage amount OSA only when the air-fuel ratio control condition is satisfied.

The control system according to this embodiment performs both of the feedback control based on the air-fuel ratio sensed by the linear air-fuel ratio sensor 3 (with the correction coefficient $\alpha$) and the feedback control based on the calculated oxygen storage amount OSA (with the coefficient H) simultaneously. However, it is optional to arrange the control system to perform only the feedback control based on the calculated oxygen storage amount OSA.

Figure 9:
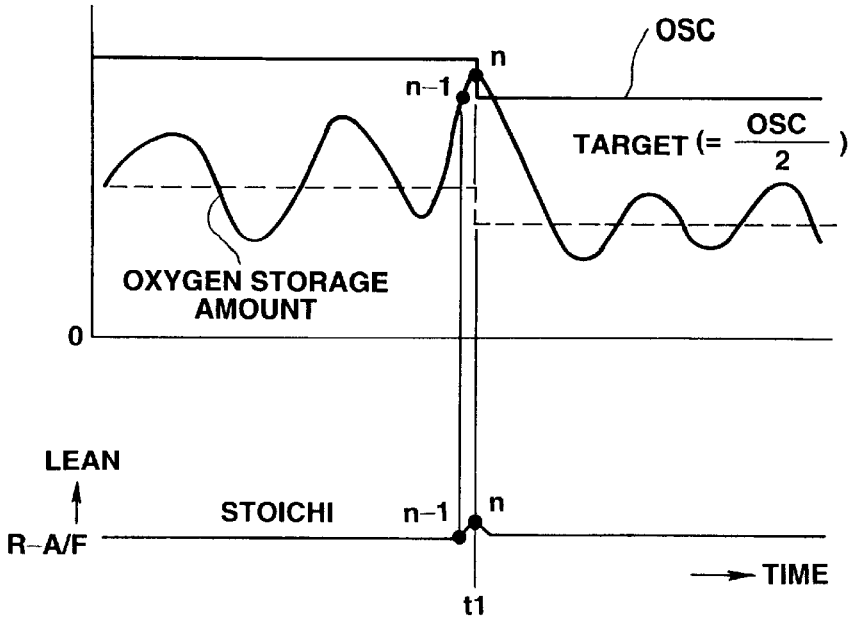
FIG. 9 is a graph for illustrating operations of the control system of FIG. 1 in the case of degradation of the catalyst.
Figure 10:
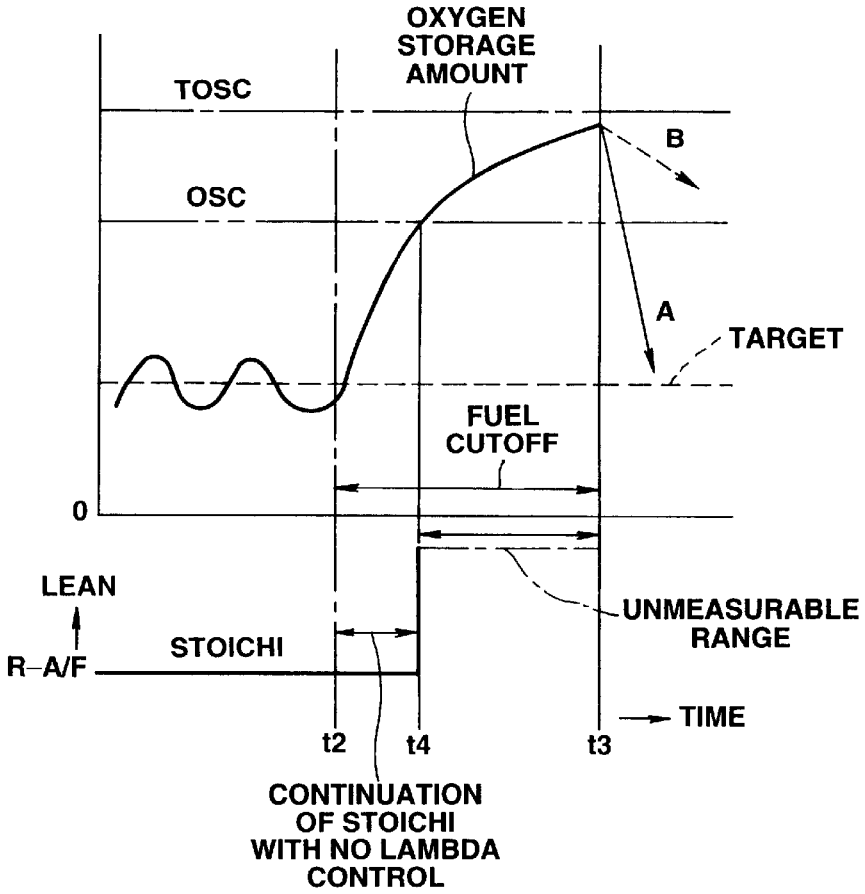
FIG. 10 is a graph for illustrating operations of the control system of FIG. 1 in the case of fuel cutoff.

FIGS. 9 and 10 illustrate operations of the thus-constructed control system according to this embodiment.

FIG. 9 shows changes due to degradation of the catalyst 10.

During the lambda control (or air-fuel ratio control) in which the air-fuel ratio of the exhaust gas flow upstream of the catalyst 10 fluctuates rich and lean periodically on both sides of the stoichiometric ratio, the control of the oxygen storage amount OSA in such a feedback control manner as to reduce the deviation of the current storage amount OSA from the target (OSC/2) causes the actual oxygen storage amount to fluctuate on both sides of the target within a control range between an upper limit of the effective oxygen storage capacity OSC and a lower limit of zero, as shown in FIG. 6. As long as the feedback OSA control is in progress, the current oxygen storage amount OSA does not exceed the upper limit of OSC.

However, the oxygen storage capacity OSC of the catalyst 10 can be decreased by degradation of the catalyst 10, and the oxygen storage amount OSA can exceed the oxygen storage capacity OSC (, so that the downstream air-fuel ratio becomes lean). The upper half of the feedback control range above the target set equal to ½ of the oxygen storage capacity OSC becomes substantially narrower by the decrease of the oxygen storage capacity OSC due to the degradation, so that the oxygen storage capacity OSC can be more readily exceeded.

In the example shown in FIG. 9, the air-fuel ratio on the downstream side of the catalyst 10 becomes lean at a time point t1. In the calculating operation at the time point t1, the control system according this embodiment learns the previous oxygen storage amount value OSAz (which is smaller than the current oxygen storage amount value OSA calculated in the current calculation cycle) as a new oxygen storage capacity OSC. The oxygen storage capacity OSC is decreased at the time point t1 as shown in FIG. 9. Accordingly, the target oxygen storage amount is also decreased as shown by a broken line in FIG. 9. Thus, the oxygen storage capacity OSC is updated each time the downstream side air-fuel ratio turns lean due to degradation of the catalyst 10, and thereby the target oxygen storage amount TOSA is always set at the middle between the upper limit of the oxygen storage capacity OSC and the lower limit of zero, to adapt the setting to the degradation of the catalyst 10.

During the feedback oxygen storage amount control, the current oxygen storage amount OSA can become negative (that is, the downstream exhaust gas stream can become rich). In this case, the oxygen storage amount OSA is reset to zero, and the calculation is restarted.

FIG. 10 illustrates behavior of the system when a fuel cutoff operation is performed during the feedback oxygen storage amount control.

In the example of FIG. 10, the fuel is cut off during a period from t2 to t3. During a period from t2 to t4, the downstream air-fuel ratio is kept substantially at the stoichiometric ratio without the lambda control. During this, the control unit 2 takes the course from the step S34 to the steps S35 and S40 in FIG. 5, and thereby continues increasing the calculated oxygen storage amount OSA.

After the oxygen storage amount OSA reaches the oxygen storage capacity OSC at t4, the control flows from the step S34 to the steps S35~S39, and the calculated oxygen storage amount OSA further increases toward the true oxygen storage capacity TOSC. Thus, during the period from t4 to t3, the oxygen storage amount OSA continues to increase, as shown in FIG. 10, by addition of the amount of oxygen absorbed by the catalyst 10 by slow absorbing reaction. Therefore, the calculation of OSA according to this embodiment can minimize the possibility of errors even if the feedback oxygen storage amount control is started again at the timing of t4.

By contrast to this, errors would be caused by failure to calculate the amount of oxygen absorbed in the catalyst 10 by slow absorbing reaction during the lean period during which the downstream air-fuel ratio is lean.

When the feedback oxygen storage amount control is resumed from the state in which the oxygen storage amount of the catalyst 10 is made greater than the oxygen storage capacity by fuel cutoff, it is desirable to return the oxygen storage amount of the catalyst promptly in the control range below the oxygen storage capacity in order for better exhaust emissions. After the resumption of the feedback oxygen storage amount control, the air-fuel ratio is made richer by the normal control so as to make the oxygen storage amount closer to the target below the oxygen storage capacity. However, when the degree of enrichment is small, the air-fuel ratio may be made lean temporarily by disturbance, and a lean exhaust gas mixture excess in oxygen may flow into the catalyst. During this period from the resumption of the feedback oxygen storage amount control to the decrease of the oxygen storage amount below the oxygen storage capacity, the catalyst 10 cannot maintain the stoichiometric atmosphere, and cannot purify the exhaust emission properly.

One way to avoid this problem is to replace the normal feedback control gain by a special gain for sufficiently enriching the air-fuel ratio in the calculation just after the fuel cutoff while OSA is greater than OSC. With the special gain, the oxygen storage amount is decreased rapidly into the feedback control range as shown by an arrow A in FIG. 10, instead of a gradual decrease shown by an arrow B with the normal gain. Thus, the control system can resume the feedback oxygen storage amount control after fuel cutoff without deteriorating the exhaust emission.

Figure 11:
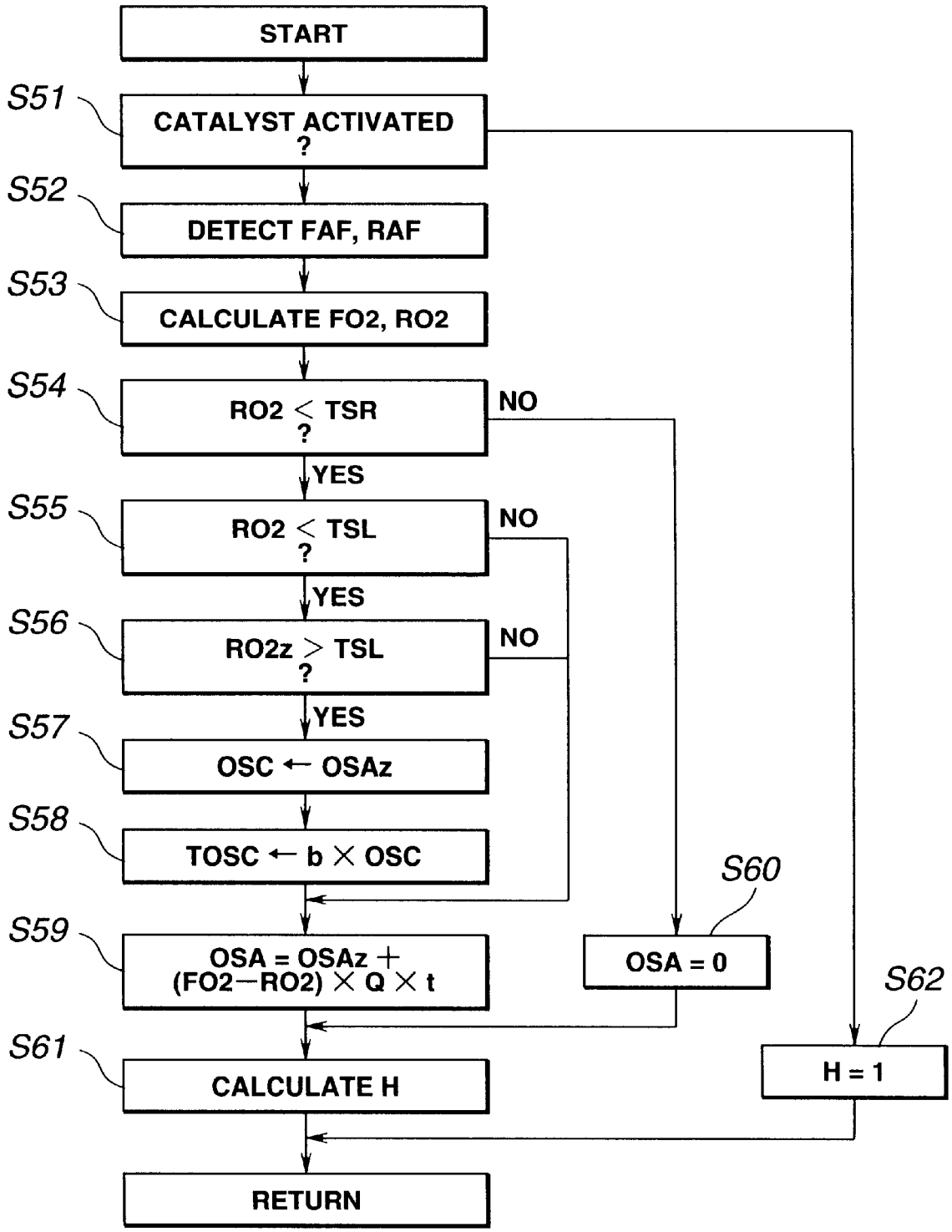
FIG. 11 is a flowchart showing an oxygen storage calculating routine according to another embodiment of the present invention.

FIG. 11 shows a control process according to a second embodiment of the present invention, for calculating the oxygen storage amount OSA according to the before-mentioned equation (2). The control system according to the second embodiment employs the routine of FIG. 11 in place of FIG. 5, and a downstream linear air-fuel ratio sensor 13' (as shown in FIG. 1) in place of the oxygen sensor 13. In other respects, the structure and operations of the second embodiment are substantially identical to those of the first embodiment. FIGS. 3, 4 and 6 are used in the second embodiment, too.

A step S51 of FIG. 11 is for checking the avtivation of the catalyst 11 (in the same manner as the step S31 of FIG. 5).

At a next step S52, the control unit 2 according to the second embodiment reads the detection signal FAF of the upstream linear air-fuel ratio sensor 3 upstream of the catalyst 10 and the detection signal RAF of the downstream linear air-fuel ratio sensor 13' downstream of the catalyst 10.

At a step S53, the sensed upstream air-fuel ratio FAF and the sensed downstream air-fuel ratio RAF obtained at the step S52 are converted, respectively, to upstream and downstream excess/deficient oxygen concentrations FO2 and RO2 according to the characteristic of FIG. 7.

At a step S54, the control unit 2 examines whether the downstream exhaust gas mixture is rich or not, by comparing the downstream excess/deficient oxygen concentration RO2 with a predetermined rich side threshold TSR. When RO2<TSR, the control unit 2 judges that the air-fuel ratio of the downstream exhaust gas mixture on the downstream side of the catalyst 10 is stoichiometric or lean, and proceeds to a step S55.

At the step S55, the control unit 2 examines whether the downstream exhaust gas mixture is lean or not, by comparing the downstream excess/deficient oxygen concentration RO2 with a predetermined lean side threshold TSL. When RO2<TSL, the control unit 2 judges that the air-fuel ratio of the downstream exhaust gas mixture on the downstream side of the catalyst 10 is lean, and proceeds to a step S56.

At the step S56, the control unit 2 determines whether the previous value RO2z of the downstream excess/deficient oxygen concentration RO2 calculated at the step S53 in the previous calculation cycle (10 ms before) is smaller than the lean side threshold TSL. The answer of the step S56 becomes YES just after the downstream air-fuel ratio on the downstream side of the catalyst 10 turns from stoichiometry to lean. In this case, the control unit 2 performs the learning and updating operations of the effective oxygen storage capacity OSC and the true oxygen storage capacity TOSC stored in the memory **2*b* in the same manner as in the steps S37 and S38 of FIG. 5**.

At a step S59, the control unit 2 calculates the current oxygen amount OSA, by adding, to the previous oxygen storage amount OSAz, the difference (FO2−RO2) between the upstream excess/deficient oxygen concentration FO2 and the downstream excess/deficient oxygen concentration RO2 multiplied by the exhaust gas flow rate Q and the cycle time t. That is, $OSA=OSAz+(FO2-RO2)\times Q\times t$. This calculation of the current oxygen storage amount OSA at the step S59 is performed not only when the downstream air-fuel ratio is stoichiometric, but also when the downstream air-fuel ratio is lean.

When the downstream air-fuel ratio is rich, the control unit 2 proceeds from the step S54 to a step S60 and resets the oxygen storage amount OSA to zero as in the step S42 of FIG. 5.

At a step S61, the control unit 2 calculates the feedback correction coefficient H for the feedback air-fuel ratio control, based on the calculated oxygen storage amount OSA. The step S61 is identical to the step S44, and the coefficient H is determined by the subroutine of FIG. 6.

When the catalyst 10 is not yet activated, the control unit 2 proceeds from the step S51 to a step S62 and fixes the feedback correction coefficient H to one (H=1).

In the second embodiment, the calculation of the oxygen storage amount is simpler and easier though two costlier linear air-fuel ratio sensors are required.

In general, oscillation of the air-fuel ratio in the atmosphere of the catalyst with certain amplitudes improves the conversion efficiency of the catalyst 10. Conversely, the feedback control to bring the oxygen storage amount toward the target has the tendency to decrease the conversion efficiency by controlling the air-fuel ratio in the catalyst's atmosphere constantly at the stoichiometric ratio.

Despite this tendency, the actual air-fuel ratio in the catalyst oscillates by irregularity appearing in the output of the air flow meter even in the steady state, and inevitable delay in the control system. Therefore, the feedback oxygen storage amount control is not problematical in practice. Moreover, it is possible to oscillate the air-fuel ratio in the catalyst's atmosphere by intentional control action.

This application is based on a prior Patent Application No. H10-295110 filed in Japan on Oct. 16, 1998. The entire contents of this prior application are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An air-fuel ratio control device for an engine, comprising:

a catalyst disposed in an exhaust passage of the engine, the catalyst absorbing oxygen when an inflowing exhaust gas mixture flowing into the catalyst is excessive in oxygen as compared with a stoichiometric exhaust gas mixture of a stoichiometric air-fuel ratio, and releasing oxygen stored in the catalyst when the inflowing exhaust gas mixture is deficient in oxygen as compared with the stoichiometric exhaust gas mixture;

a memory storing an oxygen storage capacity corresponding to an amount of oxygen stored in the catalyst when the air-fuel ratio of an outflowing exhaust gas mixture flowing out of the catalyst changes from a ratio substantially equal to the stoichiometric ratio to a lean air-fuel ratio; and a microprocessor programmed to:

calculate a current oxygen storage amount based on an oxygen absorbing rate of the catalyst which is lower when the air-fuel ratio of the outflowing exhaust gas mixture is lean than when the air-fuel ratio of the outflowing exhaust gas mixture is substantially stoichiometric;

control the air-fuel ratio of the inflowing exhaust gas mixture flowing into the catalyst, based on the current oxygen storage amount so as to make the current oxygen storage amount smaller than the oxygen storage capacity when a predetermined air-fuel ratio control condition is satisfied;

calculate an oxygen absorbing amount per predetermined time period, based on a product of a rate constant representing the oxygen absorbing rate and an excess oxygen amount in the inflowing exhaust gas mixture per predetermined time period when the inflowing exhaust gas mixture is excess in oxygen as compared with the stoichiometric air fuel mixture, the rate constant representing the oxygen absorbing rate being smaller when the air-fuel ratio of the outflowing exhaust gas mixture is lean than when the air-fuel ratio of the outflowing exhaust gas mixture is substantially stoichiometric;

calculate an oxygen releasing amount per predetermined time period, based on a deficient oxygen amount in the inflowing exhaust gas mixture per predetermined time period when the inflowing exhaust gas mixture is deficient in oxygen as compared with the stoichiometric air fuel mixture; and calculate the current oxygen storage amount based on the oxygen absorbing amount per predetermined time period and the oxygen releasing amount per predetermined time period.

2. An air-fuel ratio control device according to claim 1 wherein the rate constant representing the oxygen absorbing rate is set equal to one when the outflowing exhaust gas mixture is substantially stoichiometric, and set smaller than one when the outflowing exhaust gas mixture is lean.

3. An air-fuel ratio control device according to 1 wherein the memory further stores a true oxygen storage capacity corresponding to an amount of oxygen stored in the catalyst when the air-fuel ratio of the inflowing exhaust gas mixture and the air-fuel ratio of the outflowing exhaust gas mixture become substantially equal to each other on a lean side of the stoichiometric air-fuel ratio, and the microprocessor is further programmed to calculate a value of the rate constant representing the oxygen absorbing rate when the outflowing exhaust gas mixture is lean, based on the true oxygen storage capacity and the current oxygen storage amount.

4. An air-fuel ratio control device according to claim 3, further comprising an air-fuel ratio sensor sensing the air-fuel ratio of the outflowing exhaust gas mixture flowing out of the catalyst, wherein the microprocessor is further programmed to:

rewrite a new oxygen storage capacity into the memory when the air fuel ratio sensed by the air-fuel ratio sensor is changed from a ratio substantially equal to the stoichiometric air-fuel ratio to a lean air-fuel ratio, the new oxygen storage capacity being a value of the oxygen storage amount calculated at the time of the change of the air-fuel ratio;

estimate a new true oxygen storage capacity based on the new oxygen storage capacity; and rewrite the new true oxygen storage capacity into the memory.

5. An air-fuel ratio control device according to claim 4 wherein the air-fuel ratio sensor senses an oxygen concentration of the outflowing exhaust gas mixture, and thereby detects whether the air-fuel ratio of the outflowing exhaust gas mixture is substantially stoichiometric, lean or rich.

6. An air-fuel ratio control device according to claim 4, wherein the microprocessor is programmed to calculate the new true oxygen storage capacity by multiplying the new oxygen storage capacity by a predetermined constant.

7. An air-fuel ratio control device according to claim 3 wherein the controller is programmed to decrease the rate constant as a difference between the true oxygen capacity and the oxygen storage amount decrease, and to decrease the oxygen absorbing rate as the oxygen storage amount increases.

8. An air-fuel control device according to claim 7 wherein the controller is programmed to determine the rate constant in accordance with a fraction whose numerator is proportional to the difference between the true oxygen capacity and the oxygen storage amount and whose denominator is proportional to the oxygen storage amount.

9. An air-fuel ratio control device according to claim 1, further comprising a linear air-fuel ratio sensor sensing the air-fuel ratio of the inflowing exhaust gas mixture flowing into the catalyst in a wide range, and an exhaust gas flow meter sensing a flow rate of the inflowing exhaust gas mixture flowing into the catalyst, wherein the microprocessor is further programmed to calculate an excess oxygen amount in the inflowing exhaust gas mixture flowing into the catalyst per predetermined time period and a deficient oxygen amount in the inflowing exhaust gas mixture flowing into the catalyst per predetermined time period, based on the air-fuel ratio sensed by the linear air-fuel ratio sensor and the flow rate of the inflowing exhaust gas mixture sensed by the exhaust gas flow meter.

10. An air-fuel ratio control device according to claim 9 wherein the exhaust gas flow meter senses the flow rate of the inflowing exhaust gas mixture by sensing a flow rate of an intake air drawn into the engine.

11. An air-fuel ratio control device according to claim 9 wherein the microprocessor is further programmed to calculate the excess oxygen amount in the inflowing exhaust gas mixture flowing into the catalyst per predetermined time period, based on a predetermined oxygen concentration and the flow rate of the inflowing exhaust gas mixture when the air-fuel ratio of the inflowing exhaust gas mixture is equal to a lean air-fuel ratio beyond a measurable air-fuel ratio range of the linear air-fuel ratio sensor.

12. An air-fuel ratio control device according to claim 11 wherein the predetermined oxygen concentration is set equal to the oxygen concentration of air.

13. An air-fuel ratio control device according to claim 1, further comprising an air-fuel ratio sensor sensing the air-fuel ratio of the outflowing exhaust gas mixture flowing out of the catalyst, wherein the microprocessor is further programmed to rewrite a new oxygen storage capacity into the memory when the air-fuel ratio sensed by the air-fuel ratio sensor is changed from a ratio substantially equal to the stoichiometric air-fuel ratio to a lean air-fuel ratio, the new oxygen storage capacity being a value of the oxygen storage amount calculated at the time of the change of the air-fuel ratio.

14. An air-fuel ratio control device according to claim 1, further comprising an air-fuel ratio sensor sensing the air-fuel ratio of the outflowing exhaust gas mixture flowing out of the catalyst, wherein the microprocessor is further programmed to set the current oxygen storage amount to zero when the air-fuel ratio sensed by the air-fuel ratio sensor is a rich air-fuel ratio.

15. An air-fuel ratio control device according to claim 1, wherein the microprocessor is further programmed to:

set a target oxygen storage amount which is smaller than the oxygen storage capacity;

calculate a feedback correction quantity based on a product of a deviation of the current oxygen storage amount from the target oxygen storage amount and a control constant; and control the air-fuel ratio of the inflowing exhaust gas mixture flowing into the catalyst, based on the feedback correction quantity when the predetermined air-fuel ratio control condition exists.

16. An air-fuel ratio control device according to claim 15 wherein the microprocessor is further programmed to set the control constant to a first value when the current oxygen storage amount is greater than the oxygen storage capacity, and to a second value when the current oxygen storage amount is smaller than the oxygen storage capacity, the first value being greater than the second value.

17. An air-fuel ratio control process for an engine equipped with a catalyst disposed in an exhaust passage of the engine, the catalyst absorbing oxygen when an inflowing exhaust gas mixture flowing into the catalyst is excessive in oxygen as compared with a stoichiometric exhaust gas mixture of a stoichiometric air-fuel ratio, and releasing oxygen when the inflowing exhaust gas mixture is deficient in oxygen as compared with the stoichiometric exhaust gas mixture, the air-fuel ratio control process comprising:

storing an oxygen storage capacity corresponding to an amount of oxygen stored in the catalyst when the air-fuel ratio of an outflowing exhaust gas mixture flowing out of the catalyst changes from a ratio substantially equal to the stoichiometric ratio to a lean air-fuel ratio;

calculating a current oxygen storage amount based on an oxygen absorbing rate of the catalyst which is lower when the air-fuel ratio of the outflowing exhaust gas mixture is lean than when the air-fuel ratio of the outflowing exhaust gas mixture is substantially stoichiometric; and controlling the air-fuel ratio of the inflowing exhaust gas mixture flowing into the catalyst, based on the current oxygen storage amount so as to make the current oxygen storage amount smaller than the oxygen storage capacity when a predetermined air-fuel ratio control condition is satisfied;

wherein a process element of calculating the current oxygen storage amount comprises:

calculating an oxygen absorbing amount per predetermined time period, based on a product of a rate constant representing the oxygen absorbing rate and an excess oxygen amount in the inflowing exhaust gas mixture per predetermined time period when the inflowing exhaust gas mixture is excess in oxygen as compared with the stoichiometric air fuel mixture, the rate constant representing the oxygen absorbing rate being smaller when the air-fuel ratio of the outflowing exhaust gas mixture is lean than when the air-fuel ratio of the outflowing exhaust gas mixture is substantially stoichiometric;

calculating an oxygen releasing amount per predetermined time period, based on a deficient oxygen amount in the inflowing exhaust gas mixture per predetermined time period when the inflowing exhaust gas mixture is deficient in oxygen as compared with the stoichiometric air fuel mixture: and calculating the current oxygen storage amount based on the oxygen absorbing amount per predetermined time period and the oxygen releasing amount per predetermined time period.

18. An air-fuel ratio control device for an engine, comprising:

a catalyst disposed in an exhaust passage of the engine, the catalyst absorbing oxygen when an in-flowing exhaust gas is oxygen excessive of stoichiometric and releasing oxygen stored in the catalyst when the inflowing exhaust gas is oxygen deficient;

a microprocessor programmed to:

integrate an oxygen storage rate over a time period beginning with a state in which the catalyst is deplete of stored oxygen to produce an estimate of the oxygen storage level, obtain a first integrated value which represents a first amount of oxygen stored in the catalyst at a first point in time the air-fuel ratio of outflowing exhaust gas changes from a substantially stoichiometric condition to a lean condition, obtain a second integrated value which represents a second amount of oxygen stored in the catalyst at a second point in time the catalyst is completely saturated with oxygen, the second integrated value being greater than the first integrated value detect whether the air-fuel control condition is present, determine whether or not the estimate of the oxygen storage level lies between the first integrated value and the second integrated value; and responsive to the determination control the air-fuel ratio while maintaining the oxygen storage level at a target value which is about one-half of the first integrated value in response to the determination of the air-fuel control.

19. The air-fuel ratio control device as claimed in claim 18, wherein the microprocessor is further programmed to:

compares, at a time of determination for air-fuel control, the second integrated value to the target value, to produce a compensation value; and apply a gain to the compensation value to maintain the target value.

20. The air-fuel ratio control device as claimed in claim 19, wherein the microprocessor is further programmed to:

obtain a current storage level of oxygen stored in the catalyst by continuously integrating the storage rate over a predetermined period of time;

determine a first gain if the current storage level is less than the first integrated value;

determine a second gain, which is greater than the first gain, if the current storage level exceeds the first integrated value;

control air-fuel ratio to control the oxygen storage using the determined gain.

* * * * *